US005999107A

United States Patent [19]

Cooper et al.

[11] Patent Number: 5,999,107

[45] Date of Patent: Dec. 7, 1999

[54] REMOTE CATHODIC PROTECTION MONITORING SYSTEM

[75] Inventors: Joel Cooper, West Islip, N.Y.; Albert W. Gershman, Matawan, N.J.; Joe W. McCarty, Gary, Ind.; Arthur Shapiro, East Roackaway, N.Y.; Christopher J. Ziolkowski, Elmhurst, Ill.

[73] Assignee: Institute of Gas Technology, Des Plaines, Ill.

[21] Appl. No.: 08/967,963

[22] Filed: Nov. 12, 1997

[51] Int. Cl.[6] ..... G08B 21/00

[52] U.S. Cl. ..... 340/870.16; 204/196.36; 205/730; 324/425

[58] Field of Search ..... 340/870.16, 870.28, 340/825.54, 539; 204/196.02, 196.04, 196.07, 196.1, 196.21, 196.36; 205/725–728, 730; 324/425, 700

[56] References Cited

U.S. PATENT DOCUMENTS

| | | | |
|---|---|---|---|
| 3,860,912 | 1/1975 | Romans . | |
| 4,090,170 | 5/1978 | Lincklaen-Arriens et al. | 340/5 R |
| 4,481,474 | 11/1984 | Gerrit | 324/425 |
| 4,573,115 | 2/1986 | Halgrimson . | |
| 4,592,818 | 6/1986 | Cavil et al. . | |
| 4,644,285 | 2/1987 | Britton | 204/196.36 |
| 5,144,247 | 9/1992 | Speck . | |
| 5,216,370 | 6/1993 | Bushman et al. . | |
| 5,446,369 | 8/1995 | Byrne et al. . | |
| 5,469,048 | 11/1995 | Donohue . | |
| 5,785,842 | 7/1998 | Speck | 204/196.36 |

FOREIGN PATENT DOCUMENTS 1557153 12/1979 United Kingdom .

OTHER PUBLICATIONS

J. Derwin King, Investigation of Passive Tagging Techniques to Communicate with Buried Pipe in Gas Distribution Systems, Phase 1 Final Report, Nov. 1983, Soutwest Research Institute, San Antonio, Texas pp. 56–58, 60–62 & 67–71.

*Primary Examiner*—Michael Horabik
*Assistant Examiner*—Timothy Edwards Jr
*Attorney, Agent, or Firm*—Pauley Petersen Kinne & Fejer

[57] ABSTRACT

A cathodic protection monitoring system for buried metal objects comprising a transponder hard-wire connected to a sacrificial anode and a reference electrode, each of the transponder, the sacrificial anode and the reference electrode being buried underground in close proximity to the buried metal object to be protected, thereby forming a first principal circuit between the sacrificial anode and the buried metal object and forming a second principal circuit between the reference electrode and the buried metal object. The system further comprises a portable transceiver disposed above ground tuned to a frequency of the transponder. Power for operation of the transponder is drawn from the cathodic protection circuit, thereby obviating the need for connections to above ground power supplies.

11 Claims, 5 Drawing Sheets

REMOTE CATHODIC PROTECTION MONITORING SYSTEM

BACKGROUND OF THE INVENTION

1. Field of the Invention

This invention relates to a transponder/cathodic protection system that generates surface detectable signals that can be used to monitor and measure the effectiveness of a buried cathodic protection circuit for buried metal objects, in particular, buried metal pipes. The transponder, which is buried, converts the voltage and amperage generated by a typical cathodic protection circuit into radio frequency waves that can be detected remotely above ground by any suitable transmitter-receiver tuned to the transponder frequency.

2. Description of Prior Art

Underground metal objects, such as natural gas distribution and transmission pipelines, tend to build up electrical charges caused by the earth's magnetic field. The metal object also serves as a conductor between soils of differing chemical composition and conductivity, in effect, forming a battery and setting up circulating currents in the pipe-soil system. After a length of time, depending upon soil conductivity and conditions, the metal object will become sufficiently charged such that an electrical discharge will occur from the metal object to the ground, causing corrosion of the metal object. In the case of buried metal pipes, the electrical discharge causes metal particles to be carried away from the pipe, thereby pitting the pipe which, in turn, can cause a hole to develop at the point of discharge. Various devices have been used to counteract this electrolytic process, the most common of which is an electrical power supply, more commonly called a cathodic protection rectifier, which produces a rectified low voltage DC current. The DC current output of the rectifier is then connected to the metal object to effectively counteract or negate the electrical charge build up in a manner which prevents damage to the metal object. The metal object is, thus, made cathodic so that plating action occurs at the metal object and deplating occurs at a buried sacrificial anode.

U.S. Pat. No. 5,216,370 teaches a cathodic protection monitoring system which provides IR drop free cathodic protection potential measurements which are indicative of the effectiveness of the cathodic protection system. The system measures the polarized potential between a reference electrode and a coupon subsequent to decoupling the coupon from the protected structure. The system controls the time or times at which the potential is measured in order to ensure that the potential is measured only after the polarized potential has achieved a relatively steady state value. The system includes an above ground test module including a timing circuit and voltmeter, the test module being removably electrically attached to a switch network by way of terminals. The reference electrode is electrically coupled to the test module by way of an electrical cable; similarly, the coupon and metal structure are electrically coupled to the switch network using electrical cables.

A cathodic protection measurement system including a coupon buried near and electrically connected to a pipeline so as to receive the same level of cathodic protection current as the pipeline is taught by U.S. Pat. No. 5,469,048. A test wire is connected to the pipeline and routed to a normally closed contact switch located at an access point of an above ground test station. The switch is also connected to a coupon wire, which is routed and connected to the coupon to complete the electrical connection. A reference electrode having a measuring surface contacting the soil close to the buried coupon includes an electrode wire provided to the access point, the access point comprising a tubular access tube which penetrates the soil and extends to the pipeline being protected. A voltmeter is connected between the switch and the reference electrode wire, and the switch is then opened to electrically isolate the coupon from the pipeline. U.S. Pat. No. 5,144,247 teaches an apparatus for measuring cathodic protection voltage levels on a concealed conductive structure which includes a probe having a standard half cell reference electrode, a working electrode, and an auxiliary electrode mounted in a fixed spacial relationship to each other, wherein the reference electrode, working electrode and auxiliary electrode are each in contact with an electrolytic solution. A voltage measuring device is provided for receiving the voltage from the reference electrode. A switch is included for connecting and disconnecting the working electrode to the common reference point. See also U.S. Pat. No. 5,446,369 which also teaches a corrosion monitoring system.

Conventional cathodic protection surveying in an urban environment is a complicated and expensive process. Paving often renders it impossible to use a portable reference electrode. Buried reference electrodes can be lost as landmarks and paving shift over time. Monitoring the state of the cathodic protection of buried metallic gas distribution and transmission systems is an operation that is carried out by all system operators. The most widely accepted method of demonstrating adequate protection is to measure the pipe to soil potential with respect to a reference electrode. In practice, the reference electrode is placed in contact with the soil and a lead wire is attached to the main. The voltage between these two points is measured with a high impedance voltmeter. If the main voltage is correct with respect to the particular type of reference electrode, for example 850 millivolts for copper/copper-sulfate, the main is adequately protected. This measurement can be taken by either steady state or instant-off methods.

The urban environment offers particular challenges to carrying out the operation of cathodic protection monitoring. Often, a portable reference electrode can not be used when there is no unpaved soil nearby in which to insert the electrode. Measurements can be taken using a permanently buried electrode if lead wires are brought to the surface from the pipe and the electrode. One practice is to bring both of these lead wires to the surface in a common valve box that can be opened when a cathodic protection survey is being performed. These valve boxes can be buried, paved over, or otherwise "lost" in the shifting urban landscape.

In the case of pipelines located in remote areas, where physical connection to the cathodic protection system may not be possible and most certainly is not desirable, various devices have been used for visual observation from airplanes that routinely patrol the pipeline right-of-way to make a determination as to whether or not the systems are operating properly. The most common device utilized is simply a red light disposed on top of a pole that burns if the system is functioning properly and goes out if the system fails. Similar systems utilizing spinning pinwheels or the like which are motor driven from the output of the cathodic protection circuit are also known. Thus, when the circuit fails, the pinwheel will no longer spin. U.S. Pat. No. 3,860,912 teaches a power supply monitoring device for monitoring remote power line connected cathodic protection rectifier operation along a pipeline from pipeline patrol vehicles. The device comprises transmitter means disposed adjacent to each power supply rectifier and operably connected to the power line for transmitting a signal, monitoring means operably connected to the output of the cathodic protection rectifier for sensing the output current thereof, signal modulating means operably connected between the monitor means and the transmitter means for modulating the transmitter signal in accordance with the rectifier current level, receiver means disposed within the patrol vehicle for receiving the output of the transmitter means when the patrol vehicle is in the near proximity of the rectifier, and audio output means operably connected to the receiver means for indicating the cathodic protection rectifier current level. As in the case of other known devices, a significant portion of the monitoring device is disposed above ground and is physically connected to the below ground components.

SUMMARY OF THE INVENTION

It is an object of this invention to provide a cathodic protection monitoring system for buried metal objects, such as underground pipes, that can be remotely monitored above ground.

It is another object of this invention to provide a cathodic protection monitoring system for buried metal objects which avoids the requirement of hard wire and hook up of portable instruments at surface accessible junction boxes to measure the effectiveness of the circuit of conventional cathodic protection systems.

It is another object of this invention to provide a cathodic protection system for buried metal objects which generates surface detectable signals that can be used to monitor and measure the effectiveness of the cathodic protection circuit.

It is another object of this invention to provide a cathodic protection monitoring system which is unaffected by topological changes, such as over-paving, which can hide or otherwise render inaccessible conventional systems.

It is yet another object of this invention to provide a cathodic protection monitoring system for buried metal objects which relies upon power generated by the cathodic protection circuit underground for operation.

A cathodic protection monitoring system for buried metal objects, such as buried metal pipes, in accordance with one embodiment of this invention, comprises a transponder, a sacrificial anode, and a reference electrode, each of which is buried underground in close proximity to the buried metal object to be protected. The sacrificial anode is hard-wire connected to the transponder as is the reference electrode. In this way, a first principal circuit is formed between the sacrificial anode and the buried metal object and a second principal circuit is formed between the reference electrode and the buried metal object. A portable transceiver tuned to a frequency of the transponder is disposed above ground. In accordance with a particularly preferred embodiment of this invention, the transponder converts voltage and amperage generated by the principal circuits into radio frequency (RF) waves detectable by the transceiver.

BRIEF DESCRIPTION OF THE DRAWINGS

These and other object and features of this invention will be better understood from the following detailed description taken in conjunction with the drawings wherein.

DESCRIPTION OF PREFERRED EMBODIMENTS

Figure 1:
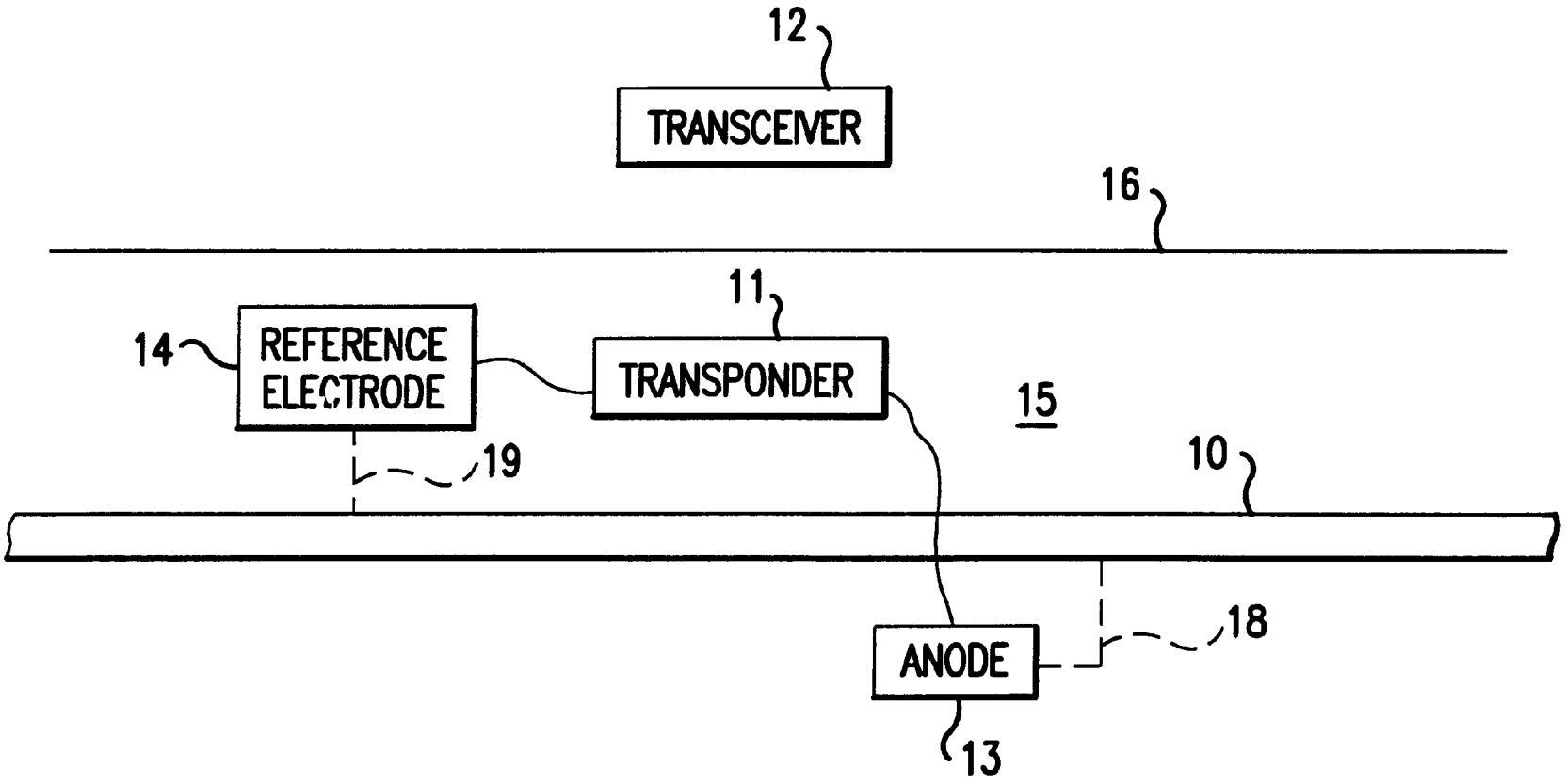
FIG. 1 is a diagram showing the general relationship between the components of the cathodic protection monitoring system in accordance with one embodiment of this invention.

A cathodic protection monitoring system for buried metal objects in accordance with one embodiment of this invention is schematically shown in FIG. 1. The cathodic protection monitoring system comprises transponder 11 hard-wire connected to sacrificial anode 13 and reference electrode 14. Each of transponder 11, sacrificial anode 13, and reference electrode 14 is buried below ground 16 in close proximity to a buried metal object to be protected, in the instant case metal pipe 10. A first principal circuit 18 is, thus, formed between sacrificial anode 13 and metal pipe 10 and a second principal circuit 19 is formed between reference electrode 14 and pipe 10. Portable transceiver 12 is disposed above ground and is tuned to a frequency of transponder 11. The cathodic protection system of this invention generates, preferably upon demand, signals which are detectable above ground by transceiver 12. Such signals are preferably radio frequency (RF) waves that can be used to monitor and measure the effectiveness of the cathodic protection circuit. As can be seen, by using RF waves, the installation and maintenance of a buried junction box, the location of which can be hidden or made inaccessible due to topological changes, such as over-paving or which can damaged due to nearby digging operations, is avoided.

In accordance with a particularly preferred embodiment of this invention, transponder 11, being RF responsive, converts the voltage and amperage generated by a typical cathodic protection circuit into RF waves that can be detected remotely above ground by transceiver 12 tuned to the transponder frequency.

Figure 2:
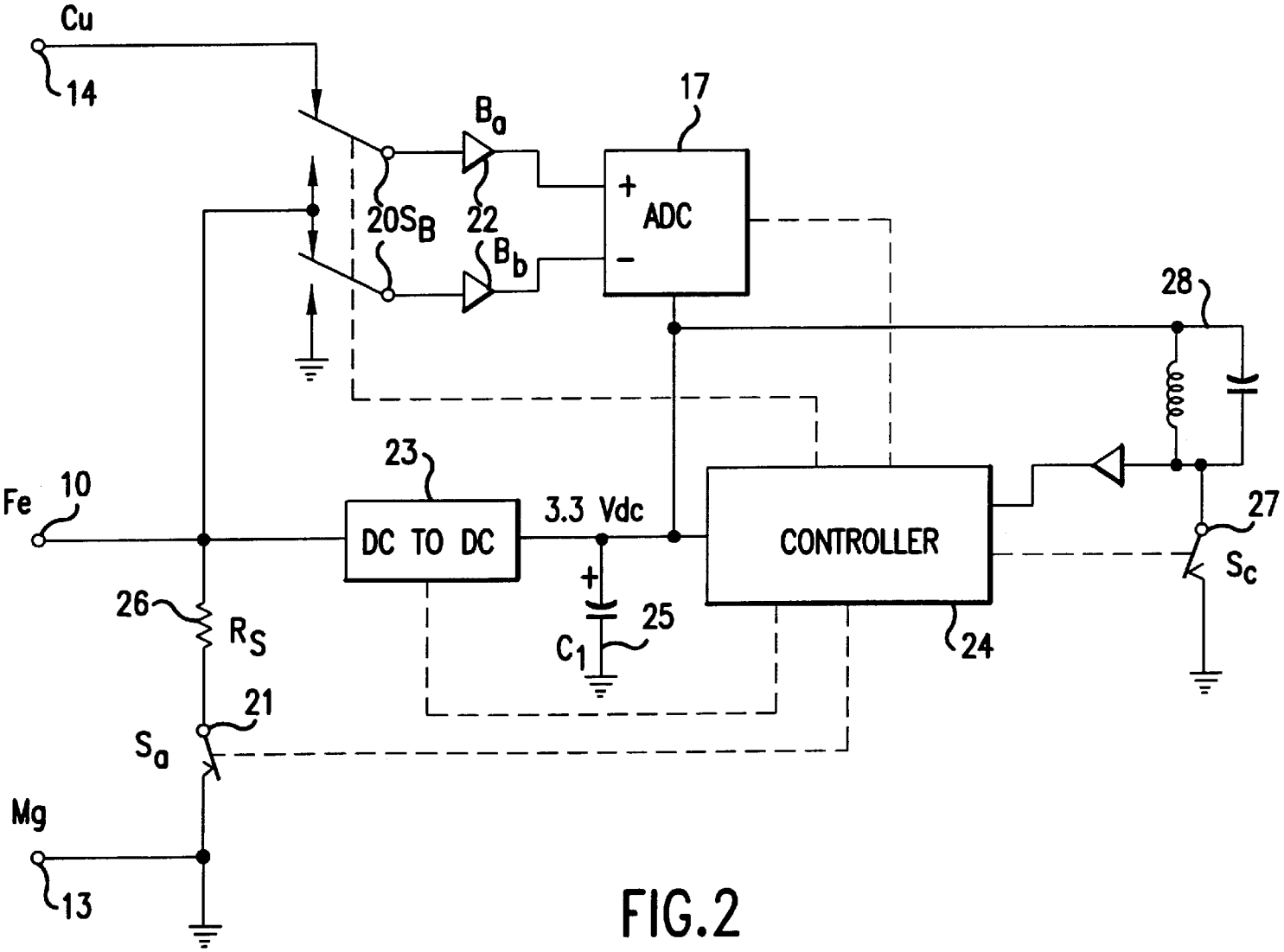
FIG. 2 is a schematic diagram showing the underground elements of the cathodic protection monitoring system in accordance with one embodiment of this invention.

Details of transponder 11 and its connections to reference electrode 14 and sacrificial anode 13 are shown in FIG. 2. Transponder 11 comprises analog-to-digital converter (ADC) 17, DC/DC converter 23, controller 24, antenna 28, high impedance buffers 22, switches 20, 21, 27, scaling resistor 26 and capacitor 25. Transponder 11 forms two principal circuits, first principal circuit between pipe 10 and sacrificial anode 13 and second principal circuit between pipe 10 and reference electrode 14. Sacrificial anode 13 and reference electrode 14 are hard wired to transponder 10, leaving soil 15 to complete each of first principal circuit 18 and second principal circuit 19. A hard-wire portion of each circuit contains a switch, 20 and 21 so that either principal circuit can be made or broken as desired using controller 24 to operate the appropriate switch 20, 21. In operation, transceiver 12 disposed above ground and controller 24 of transponder 11 communicate through encoded RF waves such that the desired switches 20, 21 can be opened or closed and the desired voltages and amperages measured upon demand. The circuit comprising pipe 10 and sacrificial anode 13 comprises resistor 26 which is sized to produce a small voltage, preferably less than about 0.2 volts, between resistor 26 and buried metal pipe 10. Voltages above about 0.2 volts jeopardize the cathodic protection afforded by the cathodic protection circuit and, thus, are not deemed to be suitable. DC/DC converter 23 and capacitor 25 are used to maintain a steady voltage for analog-to-digital converter 17 and antenna system 28. Said voltage is preferably less than about 5.5 volts and is preferably about 3.3 volts.

In normal, steady state operation, as shown in FIG. 2, switch 21 is closed completing the circuit between sacrificial anode 13 and pipe 10, thereby providing continuous, steady state, cathodic protection to pipe 10. Switch 20, preferably a double pole/double throw switch, connects reference electrode 14 and pipe 10 to analog-to-digital converter 17 through high impedance buffers 22, thereby measuring the steady state pipe to soil voltage. This voltage is converted from analog to digital values in analog-to-digital converter 17 and routed to antenna 28 by controller 24. RF waves generated by antenna 28, being indicative of the steady state pipe to soil voltage generated by the cathodic protection circuit, are intercepted at the surface by transceiver 12 tuned to the frequency of antenna 28.

Figure 5:
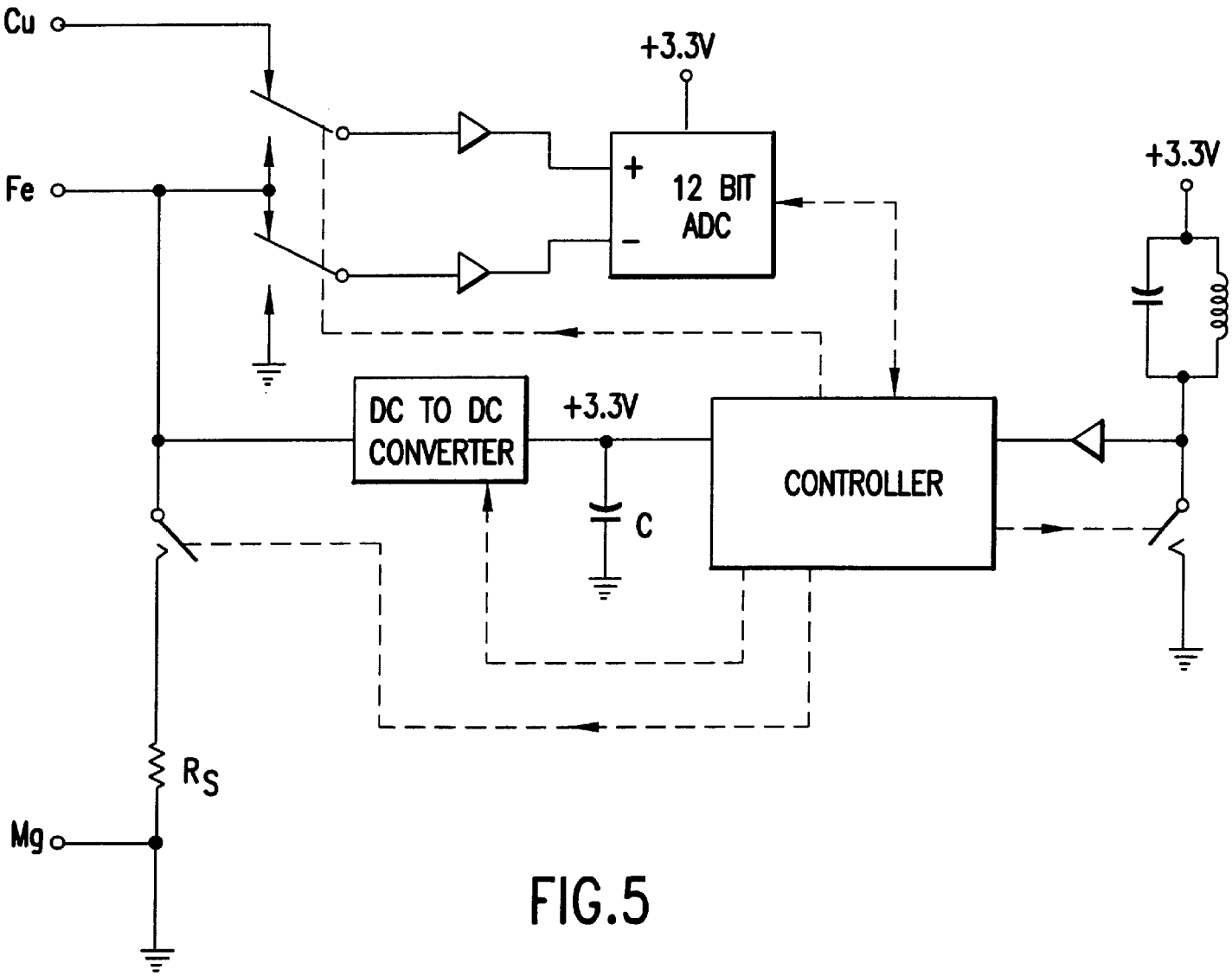
FIG. 5 is a schematic diagram of the underground portion of the cathodic protection monitoring system in accordance with one embodiment of this invention for measurement of instant-off pipe to soil voltage.

Instant-off voltages of the cathodic protection circuit indicates the level of polarization at the surface of pipe 10. Its decay rate indicates corrosion activity. The circuit for measuring this decay rate is shown in FIG. 5. Switch 21 is momentarily opened causing an immediate decay in the voltage of the circuit and a corresponding decay in the voltage input to analog-to-digital converter 17 and, thus, in the RF waves emitted by antenna 28 and detected by surface transceiver 12. During this time, capacitor 25 maintains the supply voltage at about 3.3 volts. Upon completion of these measurements, switch 21 is again closed, returning the cathodic protection circuit to its normal, steady state mode of operation. Because of possible failure, switch 21 is preferably designed to fail closed, thus assuring continuous operation of the cathodic protection circuit.

The cathodic protection circuit set to measure the steady state amperage thereof comprises switch 20 positioned to open the connection between reference electrode 14 and analog-to-digital converter/ground 17 through buffer 22*b*. In this mode, the voltage difference at analog-to-digital converter 17, which is indicative of the amperage flow in the cathodic protection circuit, depending on the size of resistor 26, is converted to analog to digital values and routed to antenna 28 for transmission to surface transceiver 12. Signal transmission is effected by the intermittent operation of switch 27 which completes the antenna-to-ground circuit when closed, thereby energizing antenna 28. When energized, antenna 28 emits RF waves indicative of the appropriate measurement.

Figure 3:
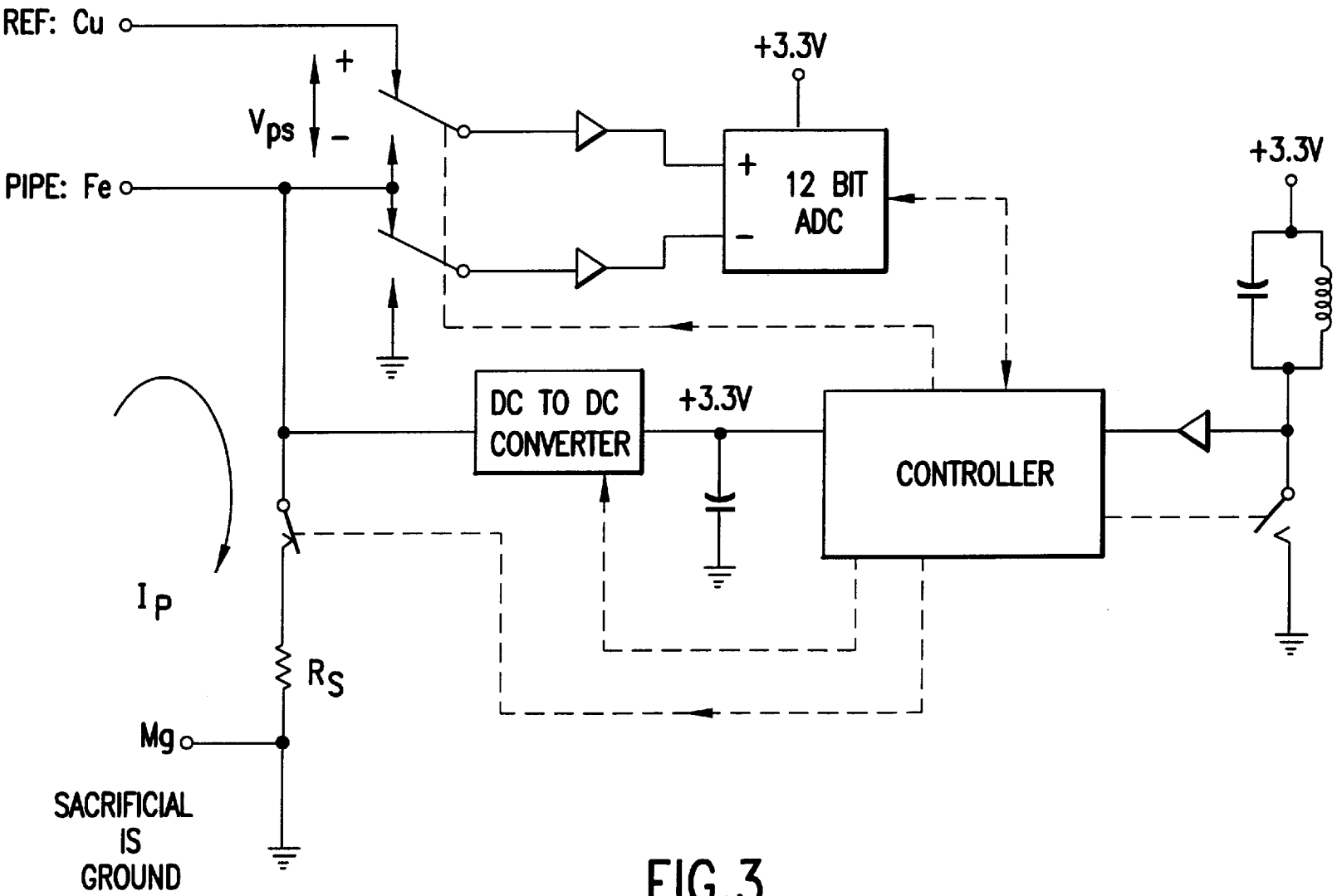
FIG. 3 is a schematic diagram showing the circuitry of the underground portion of the cathodic protection monitoring system for measurement of steady state pipe to soil voltage.
Figure 4:
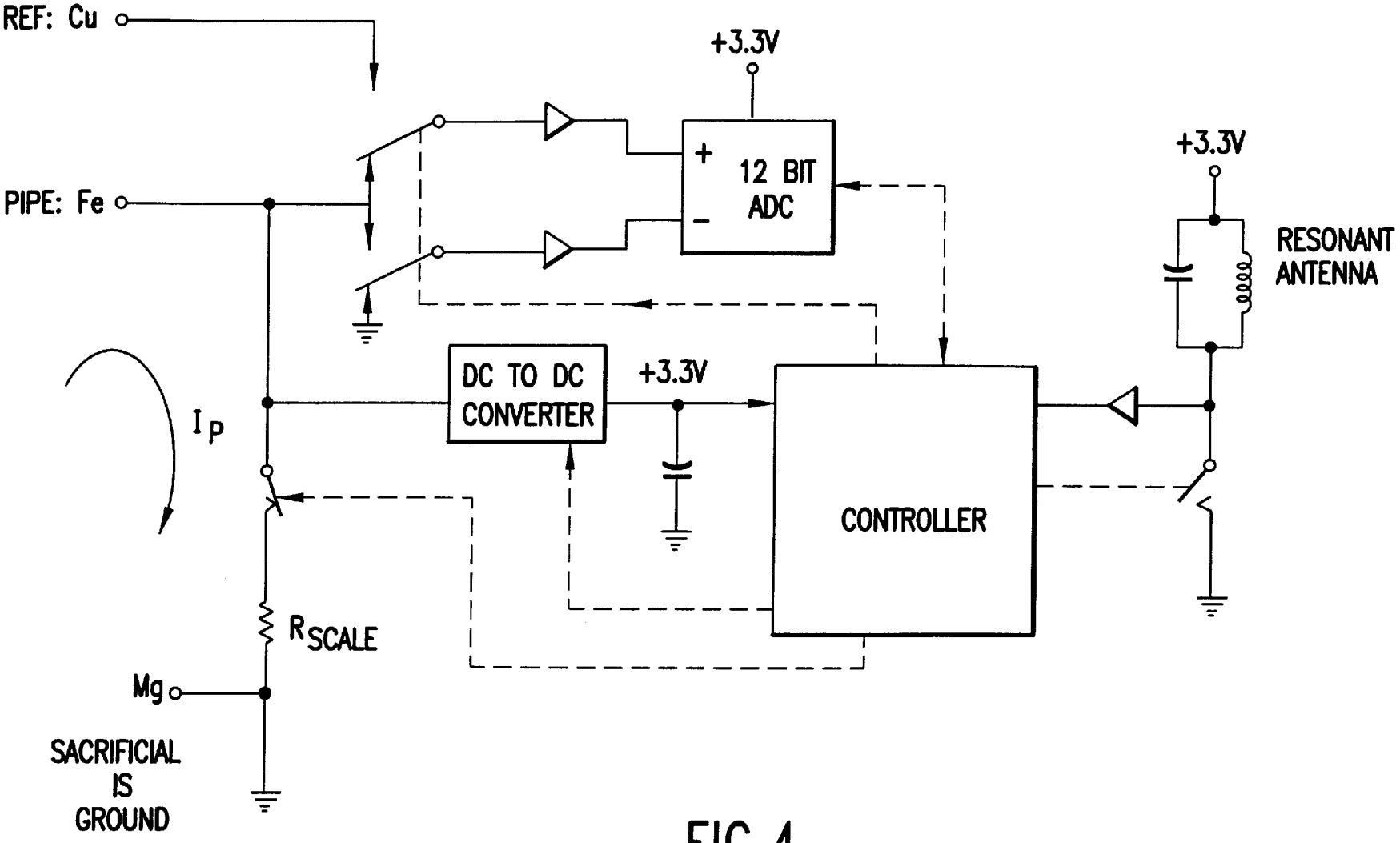
FIG. 4 is a schematic diagram showing the underground portion of the cathodic protection monitoring system of this invention for measurement of cathodic protection current.

The circuit for measurement of steady state pipe to soil voltage and amperage and the rate of voltage decay of the cathodic protection circuit is shown in FIG. 3 by which the effectiveness of the circuit, its continuity, polarization, protection level and remaining life of the sacrificial anode, can be determined.

Power for transponder 11 is provided, in accordance with one embodiment, from the surface by an electromagnetic coupler or in accordance with another embodiment by power provided from a separate soil battery. In accordance with a particularly preferred embodiment of this invention, a small amount of power is drawn from second principal circuit 19, or more preferably, from the cathodic protection circuit. In the case of the electromagnetic coupler, the coupler is tuned to the same resonant frequency as antenna 28 which then acts as a resonator. In operation, an energy pulse is emitted from surface transceiver 12 and, when received by antenna 28, continues as stored energy which echoes back to surface transceiver 12. The cathodic protection and/or reference electrode voltage is then used to modify the duration of frequency, preferably the frequency of this echo pulse, thereby indicating the value of the modifying voltage. The stored energy is also used to operate other components, such as switches, of transponder 11. A separate buried antenna can be used for this purpose, or preferably, the antenna 28 of transponder 11 can be used.

In a more preferred mode of operation, transponder 11 is programed to emit intermittent encoded signals which can be intercepted by surface transceiver 12 and used to locate the buried transponder/cathodic protection system, even if over-paved.

Any type of switches can be used in transponder 11 although solid state switches are preferred because of their lack of moving parts and contact points, thereby eliminating the occurrence of contact point polarization and providing higher reliability.

The sacrificial anode 13 is preferably made of zinc or magnesium. The reference electrode is preferably a standard half cell, in particular a copper/copper-sulfate half cell.

A method for monitoring a cathodic protection system in accordance with one embodiment of this invention comprises converting a voltage generated by a cathodic protection circuit comprising a transponder, a sacrificial anode, and a reference electrode, all of which are buried underground in close proximity to a metal object being protected, from a analog value to a digital value, and routing the digital value to an antenna of said transponder which generates radio frequency waves. The radio frequency waves are then intercepted above ground by a transceiver tuned to a frequency of the antenna. An absence of the radio frequency waves is indicative of a breakdown in the cathodic protection circuit.

It will be apparent to those skilled in the art that transponder 11 can be easily modified and used to perform many other functions, such as detecting and/or measuring the water flow in underground pipes, sewers, tunnels and the like, the electrical flow in underground power lines, and the compaction of back fill or road base.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

We claim:

1. A cathodic protection monitoring system for buried metal objects comprising;

a transponder;

a sacrificial anode hard-wire connected to the transponder;

a reference electrode hard-wire connected to said transponder;

each of said transponder, said sacrificial anode and said reference electrode buried underground in close proximity to a buried metal object to be protected, forming a first principal circuit between said sacrificial anode and said buried metal object and forming a second principal circuit between said reference electrode and said buried metal object;

wherein said transponder converts a voltage and amperage generated by said principal circuits into radio frequency wave detectable by a portable transceiver; and said portable transceiver is disposed above ground, said portable transceiver tuned to a frequency of said transponder.

2. A cathodic protection monitoring system in accordance with claim 1, wherein said first principal circuit comprises at least one resistor sized to produce a voltage less than about 0.2 volt between said resistor and said buried metal object.

3. A cathodic protection monitoring system in accordance with claim 1, wherein said sacrificial anode is one of zinc and magnesium.

4. A cathodic protection monitoring system in accordance with claim 1, wherein said hard-wire portion of each said principal circuit comprises a switch.

5. A cathodic protection monitoring system in accordance with claim 4, wherein said switch in said second principal circuit is a double pole/double throw switch.

6. A cathodic protection monitoring system in accordance with claim 1, wherein said reference electrode is a standard half cell.

7. A cathodic protection monitoring system in accordance with claim 6, wherein said standard half cell is a copper/copper sulfate half cell.

8. A cathodic protection monitoring system in accordance with claim 1, wherein said transponder comprises an analog-to-digital converter, a DC/DC converter, a controller, an antenna, at least one high impedance buffer, at least one switch, at least one scaling resistor, and at least one capacitor.

9. A cathodic protection monitoring system in accordance with claim 8, wherein said DC/DC converter and said at least one capacitor maintain a steady voltage for said analog-to-digital converter and said antenna.

10. A cathodic protection monitoring system in accordance with claim 9, wherein said steady voltage is lesss than about 5.5 volts.

11. A method for monitoring a cathodic protection system comprising:

converting a voltage generated by a cathodic protection circuit comprising a transponder, a sacrificial anode and a reference electrode, all of which are buried underground in close proximity to a metal object being protected, from an analog value to a digital value and routing said digital value to an antenna which generates radio frequency waves; and intercepting said radio frequency waves above ground with a transceiver tuned to a frequency of said antenna, whereby an absence of said radio frequency waves is indicative of a breakdown in said cathodic protection circuit.

* * * * *